US008726500B2

(12) United States Patent
Hagi et al.

(10) Patent No.: US 8,726,500 B2
(45) Date of Patent: May 20, 2014

(54) METHOD FOR MANUFACTURING ELECTRIC WIRE WITH TERMINAL

(75) Inventors: Masahiro Hagi, Yokkaichi (JP); Hiroki Shimoda, Yokkaichi (JP); Hiroki Hirai, Yokkaichi (JP); Junichi Ono, Yokkaichi (JP); Tetsuji Tanaka, Yokkaichi (JP); Takuji Otsuka, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 290 days.

(21) Appl. No.: 13/256,360

(22) PCT Filed: Mar. 18, 2010

(86) PCT No.: PCT/JP2010/054635

§ 371 (c)(1),
(2), (4) Date: Sep. 13, 2011

(87) PCT Pub. No.: WO2010/110160

PCT Pub. Date: Sep. 30, 2010

(65) Prior Publication Data

US 2012/0000069 A1 Jan. 5, 2012

(30) Foreign Application Priority Data

Mar. 23, 2009 (JP) ..... 2009-070540
Sep. 9, 2009 (JP) ..... 2009-208458

(51) Int. Cl.
*H01R 43/04* (2006.01)

(52) U.S. Cl.
USPC ..... 29/863; 29/861; 29/862

(58) Field of Classification Search
USPC ..... 29/861, 862, 863
See application file for complete search history.

(56) References Cited

U.S. PATENT DOCUMENTS

| | | | | | |
|---|---|---|---|---|---|
| 3,717,842 | A | * | 2/1973 | Douglas, Jr. | 29/860 |
| 3,931,726 | A | * | 1/1976 | Grubb | 72/430 |
| 4,315,175 | A | * | 2/1982 | Hamilton et al. | 310/71 |
| 4,317,277 | A | * | 3/1982 | Bennett et al. | 29/860 |
| 2006/0208838 | A1 | | 9/2006 | Beuscher et al. | |

FOREIGN PATENT DOCUMENTS

| | | | |
|---|---|---|---|
| CN | 1591979 | A | 3/2005 |
| CN | 1748343 | A | 3/2006 |
| JP | A-10-125362 | | 5/1998 |
| JP | A-2003-272728 | | 9/2003 |
| JP | A-2003-317817 | | 11/2003 |
| JP | A-2007-513475 | | 5/2007 |
| WO | WO 2005/055371 | A1 | 6/2005 |

OTHER PUBLICATIONS

International Search Report dated May 11, 2010 in International Application No. PCT/JP2010/054635.
Written Opinion of the International Searching Authority dated May 11, 2011 in International Application No. PCT/JP2010/054635 (with translation).
Office Action issued in Chinese Application No. 201080013106.5 dated May 29, 2013 (with translation).

* cited by examiner

*Primary Examiner* — Carl Arbes
(74) *Attorney, Agent, or Firm* — Oliff PLC

(57) ABSTRACT

A method for manufacturing an electric wire with a terminal, includes crimping a barrel portion of the terminal onto a core wire constructed of metal wires and creating a crack in a metal oxide layer immediately before the crimping. The metal oxide layer is formed on a metal surface of the core wire. The creating of crack is accomplished by applying a mechanical force to the metal oxide layer.

4 Claims, 24 Drawing Sheets

METHOD FOR MANUFACTURING ELECTRIC WIRE WITH TERMINAL

TECHNICAL FIELD

The present invention relates to a method for manufacturing an electric wire with a terminal.

BACKGROUND ART

Electrical wires having an aluminum or aluminum-alloy (hereinafter referred to as an aluminum or the like) core wires have been used for power applications such as electrical lines from power plants. In recent years, applications of electronic wires having the same kind of core wires to wires in vehicles to reduce weights of the vehicles are expected.

The wires used for such a purpose have bare parts of core wires located at ends of the wires and from which sheath are stripped off. Wire barrel of terminals are crimped onto ends of the respective core wires, and the terminals are connected to terminals of counter parts.

A metal used for each core wire has characteristics that a metal oxide layer having insulating properties is easily formed on a surface of the core wire. Therefore, a high contact resistance may be present between the core wire and the terminal. Aluminum oxide layers that are very hard are easily formed on surfaces of core wires made of aluminum or the like. As a result, a high contact resistance appears between each core wire and a terminal, which is a problem. One method to reduce the contact resistance between the core wire and the terminal is that a wire barrel having serration grooves is crimped onto the core wire.

When the terminal having the serration grooves is crimped on to the core wire, edges of the serration grooves rub against the metal oxide layer on the surface of the core wire. As a result, the metal oxide layer is cracked and a new metal surface of the core wire emerges. The wire barrel of the terminal is in contact with the new metal surface. Therefore, the contact resistance between the core wire and the terminal can be reduced.

Patent Document 1: Japanese Patent Application Publication No. 10-125362.

DISCLOSURE OF THE INVENTION

If a low pressure is applied to the core wire during the crimping of the terminal, the metal oxide layer on the surface of the core wire is not sufficiently cracked. As a result, the terminal is not in good contact with the metal under the metal oxide layer. Namely, the contact resistance cannot be sufficiently reduced by the above method.

If a high pressure is applied to the core wire during the crimping of the terminal, a large stress concentrates on the core wire on which the terminal is crimped and the core wire is more likely to be broken. This may reduce reliability of mechanical connection between the terminal and the electric wire.

The above problem is also applicable for wires having core wires made of metal other than aluminum or the like (e.g., copper or copper alloy).

Therefore, there is a need in the art to provide a method for manufacturing an electric wire with an insulator and a terminal that is crimped onto a core wire with an appropriate force so that the core wire is not broken and a contact resistance between the electric wire and the terminal is low.

SUMMARY

The present invention relates to a method for manufacturing an electric wire with a terminal, a barrel portion of which is crimped onto a core wire constructed of metal wires. The method includes at least creating a crack in a metal oxide layer formed on a metal surface of the core wire by applying a mechanical force to the metal oxide layer immediately before crimping the barrel portion of the terminal onto the core wire.

By creating the crack in the metal oxide layer on the surface of the core wire immediately before the crimping of the barrel portion of the terminal onto the core wire, a new metal surface emerges from the metal oxide layer through the crack.

Even when the new metal surface does not emerge, the crack, which is created in the metal oxide layer in advance, expands during the crimping of the barrel portion of the terminal onto the core wire. As a result, the new metal surface emerges and the barrel portion of the terminal is properly in contact with the core wire.

According to the present invention, the crack is created in the metal oxide layer formed on the core wire in advance. Therefore, the contact resistance between the terminal and the core wire can be maintained at a low level even when the pressure applied to the terminal during the crimping is reduced.

EXPLANATION OF REFERENCE CHARACTERS

Figure 1:
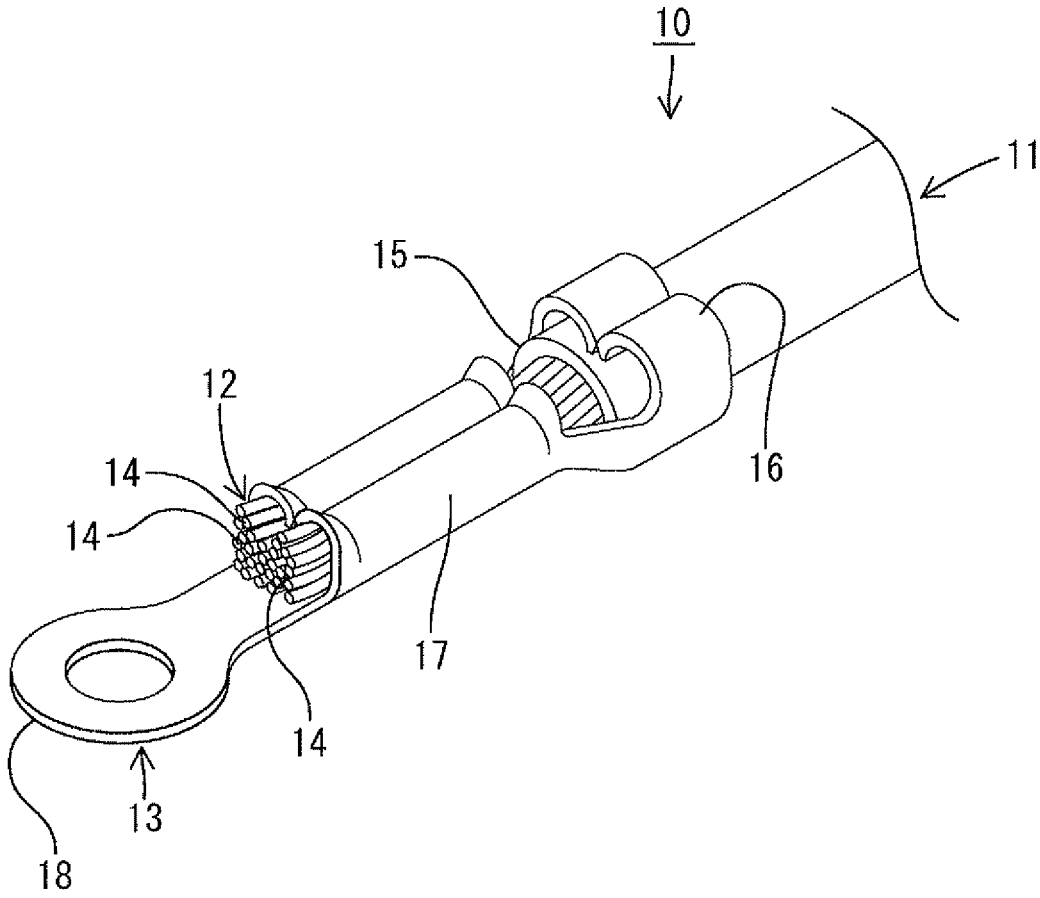
FIG. 1 is a perspective view of a terminal manufactured by a method according to the first embodiment.

10: Electric wire with a terminal
11: Electric wire
12: Core wire
13: Terminal
21, 31, 41: Pressing machine
25: Crimping machine
51, 61, 74: Roll-pressing machine

BEST MODE FOR CARRYING OUT THE INVENTION

First Embodiment

The first embodiment of the present invention will be explained with reference to FIGS. 1 to 5. An electric wire 10 with a terminal of this embodiment includes an electrical wire 11 and a terminal 13. The electrical wire 11 includes a core wire 12 covered by a resin insulator. The core wire 12 is bared at an end of the electrical wire 11. The terminal 13 is crimped onto the bare part of the core wire 12.

Figure 2:
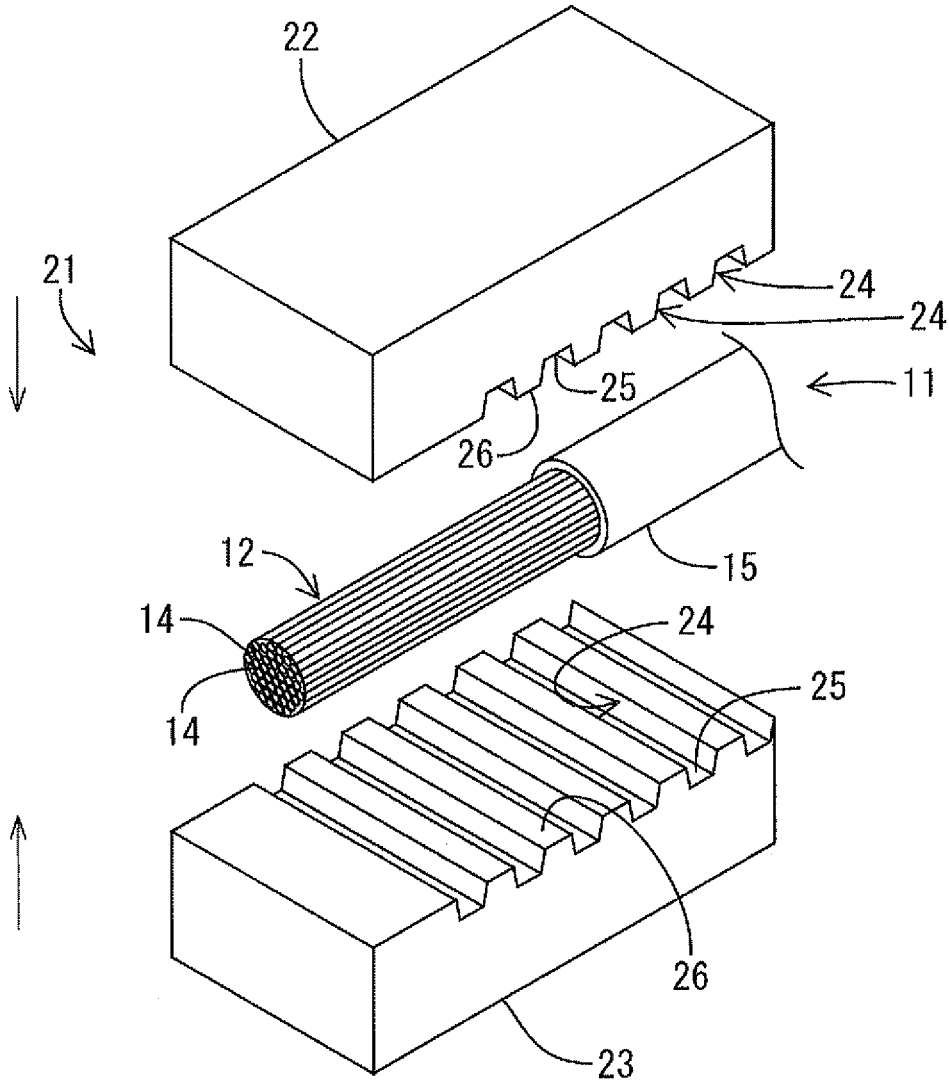
FIG. 2 is a perspective view illustrating an electric wire and a pressing machine of the first embodiment before a pressing process of the electric wire by the pressing machine.

As illustrated in FIG. 2, the electric wire 11 includes the core wire 12 and an insulator 15. The core wire 12 is constructed of a plurality of twisted metal wires 14. The insulator 15 is made of synthetic resin having insulating properties. The insulator 15 surrounds a bunch of the twisted metal wires 14. Each metal wire 14 is made of copper, copper alloy, aluminum, aluminum alloy or any other kind of metal suitable for an application. In this embodiment, an aluminum alloy is used. At the end of the electric wire, the insulator 15 is stripped off and the core wire 12 is bared.

Figure 3:
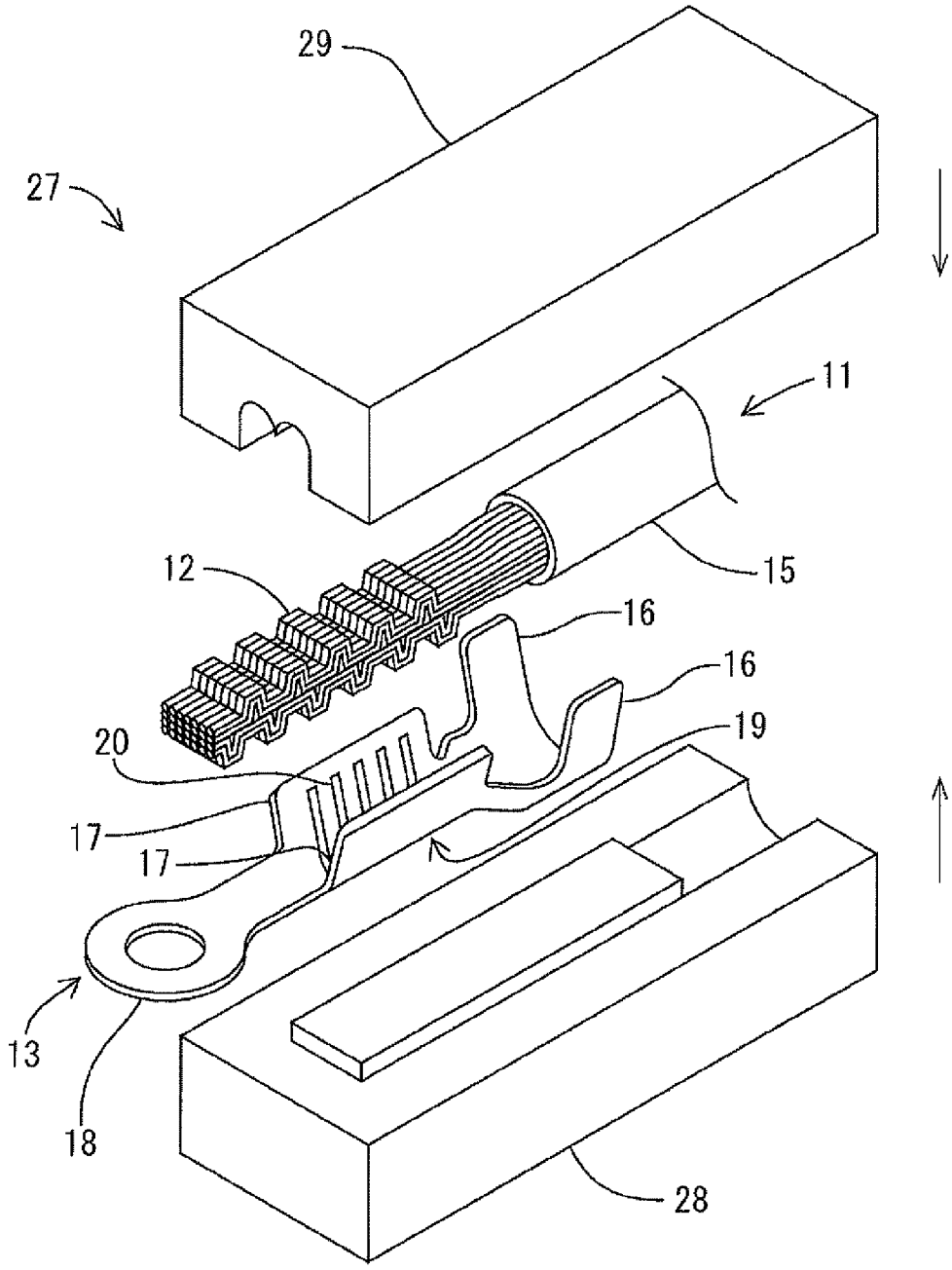
FIG. 3 is a perspective view illustrating the electric wire, a terminal, and a crimping machine of the first embodiment before a crimping process of the terminal onto the electric wire by the crimping machine.

As illustrated in FIG. 3, the terminal 13 is prepared by pressing a metal plate into a predetermined shape with a die. The terminal 13 includes an insulator barrel 16, a wire barrel 17, and a connecting tip 18. The insulator barrel 16 is crimped onto the insulator 15 of the electric wire 11 so as to surround the insulator 15. The wire barrel 17 continues from the insulator barrel 16 and crimped onto the core wire 12 so as to surround the core wire 12. The connecting tip 18 continues from the wire barrel 17. The connecting tip 18 is to be connected to a terminal of counter part. Each of the insulator barrel 16 and the wire barrel 17 has a pair of plates that project upward. A body 19 in which the wire barrel 16 is formed has a plurality of serration grooves 20 that extend in a direction perpendicular to the core wire 12. The serration grooves 20 are formed by pressing.

The electric wire 10 with the terminal in this embodiment is manufactured as follows.

Figure 4:
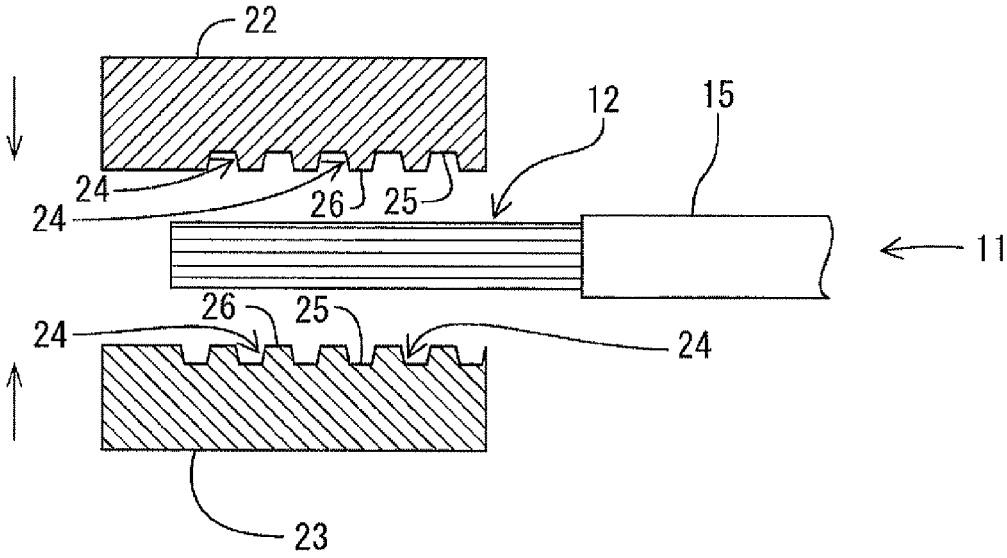
FIG. 4 is a cross-sectional view of the electric wire and the pressing machine of the first embodiment before the pressing process of the electric wire by the pressing machine.

First, a preprocess illustrated in FIG. 2 is performed. In the preprocess, the core wire 12 is pressed by a pressing machine 21. The pressing machine 21 includes an upper die 22 and a lower die 23. Opposed surfaces of the dies 22 and 23 have a plurality of rectangular grooves 24 formed at predetermined intervals and parallel to each other. As illustrated in FIG. 4, a width of each rectangular groove 24 is a half of each of the above intervals. Furthermore, the rectangular grooves 24 of the upper die 22 are displaced from the rectangular grooves 24 of the lower die 23 by the width thereof. Namely, recessed portions 25 and protruding portions 26 of the upper die 22 and the lower die 23 are aligned with each other. The core wire 12 of the electric wire 11 is set in the pressing machine 21 perpendicular to the rectangular grooves 24. The core wire 12 is sandwiched between the upper die 22 and the lower die 23, and pressed.

Figure 5:
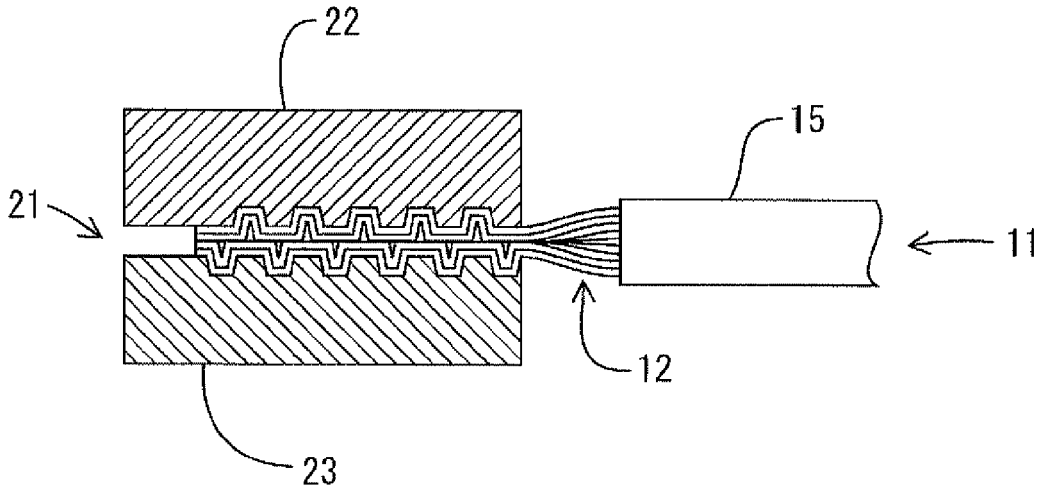
FIG. 5 is a cross-sectional view of the electric wire and the pressing machine of the first embodiment in a preprocess of the electric wire by the pressing machine.

Through the preprocess, the core wire 12 is plastically deformed into a rectangular wave-like shape as illustrated in FIG. 5. Surfaces of the core wire 12 at bent parts thereof in rectangular shapes are stretched along the longitudinal direction of the core wire 12. Therefore, even when metal oxide layers (aluminum oxide layers for the aluminum alloy) are formed on the surfaces of the core wire 12, many cracks are created in the metal oxide layers, which are relatively hard and formed on the surfaces, in the bent parts. New metal surfaces may emerge from the metal oxide layers.

Next, the terminal 13 is crimped onto the core wire 12 by a known crimping machine 27 as illustrated in FIG. 3. The terminal 13 is placed on an anvil 28 of the crimping machine 27, and then the bare part of the core wire 12 of the electric wire 11 is set at a predetermined position on the terminal 13. A crimper 29 is lowered to the core wire 12 and the terminal 13 set as above. The insulator 15 is swaged by the insulator barrel 16, and the core wire 12 is swaged by the wire barrel 17.

When the core wire 12 is swaged by the wire barrel 17, the core wire 12 is pressed and stretched by the wire barrel 17. As a result, the core wire 12 is plastically deformed. During the plastic-deformation of the core wire 12, the cracks in the metal oxide layers on the surfaces of the core wire 12 easily expand even the amount of the plastic-deformation is small. This is because the cracks are created in advance in the preprocess. New metal surfaces emerge from the metal oxide layers. The terminal 13 is in contact with the new metal surfaces. As a result, proper electrical connection is established between the core wire 12 and the terminal 13.

Especially, the edges of the serration grooves 20 of the terminal 13 in this embodiment sharply bite into the new metal surfaces of the core wire 12. Therefore, large contact areas are provided between the new metal surfaces of the core wire 12 and the terminal 13. This contributes to reducing the resistance.

According to the first embodiment, the preprocess is performed immediately before the crimping of the wire barrel of the terminal 13 onto the core wire 12. In the preprocess, the core wire 12 is pressed. As a result, the metal oxide layers on the surfaces of the core wire 12 are cracked in the preprocess.

Even when the pressure applied in the crimping process of the terminal 13 is reduced, sufficient areas of the new metal surfaces of the core wire 12 under the metal oxide layers are properly in contact with the terminal 13. Therefore, the contact resistance between the core wire 12 and the wire barrel 17 can be reduced in comparison to the wire barrel 17 crimped onto the core wire 12 only by a known crimping process.

To achieve the same resistance as the resistance between the core wire 12 and the wire barrel 17 crimped onto the core wire 12 by the known crimped process, a lower crimping pressure is required. Therefore, the metal wires 14 of the core wire 12 are less likely to be broken by the edges of the wire barrel 17 due to a high crimping pressure in the crimping process. Strength of mechanical connection (or a tension strength) between the electric wire 11 and the terminal 13 can be increased.

Second Embodiment

The second embodiment will be explained with reference to FIGS. 6 and 7. A preprocess of this embodiment is different from that of the first embodiment but other configurations are the same as the first embodiment. The same parts as those of the first embodiment will be indicated by the same symbols and will not be explained.

Figure 6:
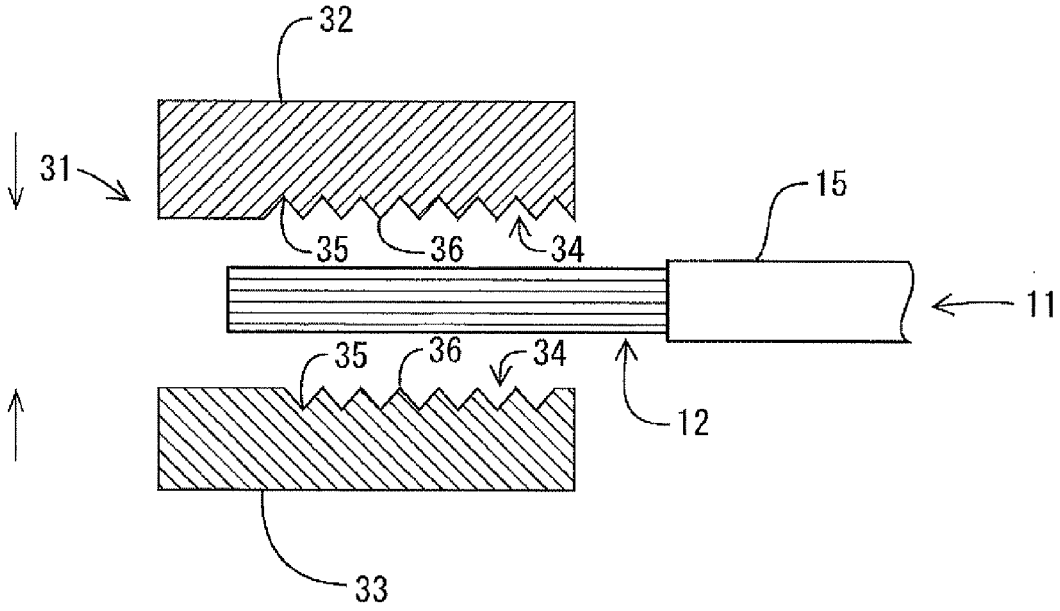
FIG. 6 is a cross-sectional view of an electric wire and a pressing machine of the second embodiment before a preprocess of the electric wire by the pressing machine.

As illustrated in FIG. 6, a pressing machine 31 of this embodiment includes an upper die 32 and a lower die 33. Opposed surfaces of the dies 32 and 33 have a plurality of triangular grooves 34 formed at predetermined intervals so as to extend parallel to each other.

A width of each triangular groove 34 is a half of each of the above intervals. Furthermore, the triangular grooves 34 of the upper die 32 are displaced from the triangular grooves 34 of the lower die 33 by the width thereof. Namely, recessed portions 35 and protruding portions 36 of the upper die 32 and the lower die 33 are aligned with each other. The core wire 12 of the electric wire 11 is set in the pressing machine 31 perpendicular to the triangular grooves 34. The core wire 12 is pressed in the triangular grooves 34.

Figure 7:
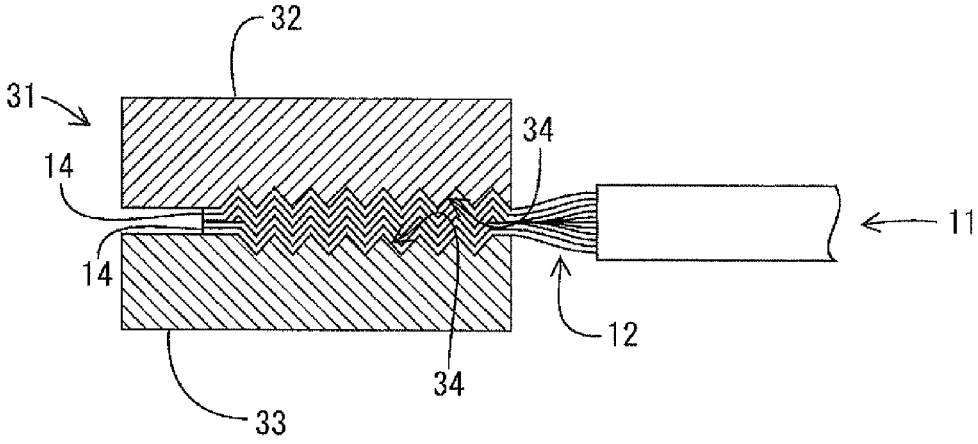
FIG. 7 is a cross-sectional view of the electric wire and the pressing machine of the second embodiment in the preprocess of the electric wire by the pressing machine.

The preprocess is performed on the core wire 12 of the electric wire 11 by the pressing machine 31 as illustrated in FIG. 7. Through the preprocess, the core wire 12 is pressed and plastically deformed into a wave-like form along the triangular grooves 34. Surfaces of the core wire 12 at parts thereof bent so as to form the wave-like shape are stretched along the longitudinal direction of the core wire 12. Therefore, even when metal oxide layers are formed on the surfaces of the core wire 12, many cracks are created in the metal oxide layers. New metal surfaces may emerge from the metal oxide layers.

Similar to the first embodiment, even when the pressure applied in the crimping process of the terminal 13 is reduced, sufficient areas of the new metal surfaces of the core wire 12 emerging from the metal oxide layers are properly in contact with the terminal 13. Therefore, the contact resistance between the core wire 12 and the wire barrel 17 can be reduced.

Third Embodiment

The third embodiment will be explained with reference to FIGS. 8 to 10. A preprocess of this embodiment is different from that of the first embodiment but other configurations are the same as the first embodiment. The same parts as those of the first embodiment will be indicated by the same symbols and will not be explained.

Figure 8:
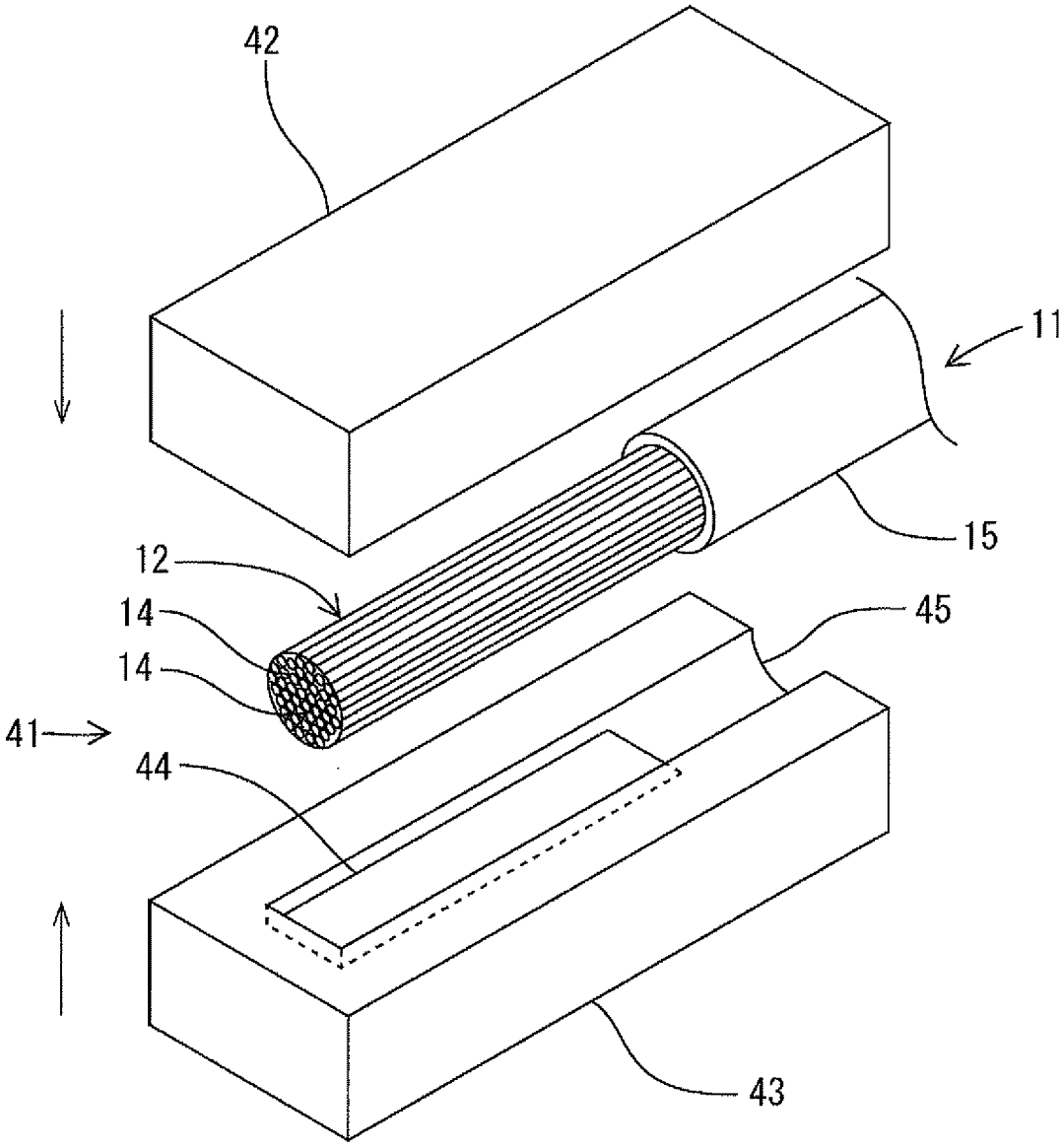
FIG. 8 is a perspective view of an electric wire and a pressing machine of the third embodiment before a preprocess of the electric wire by the pressing machine.
Figure 9:
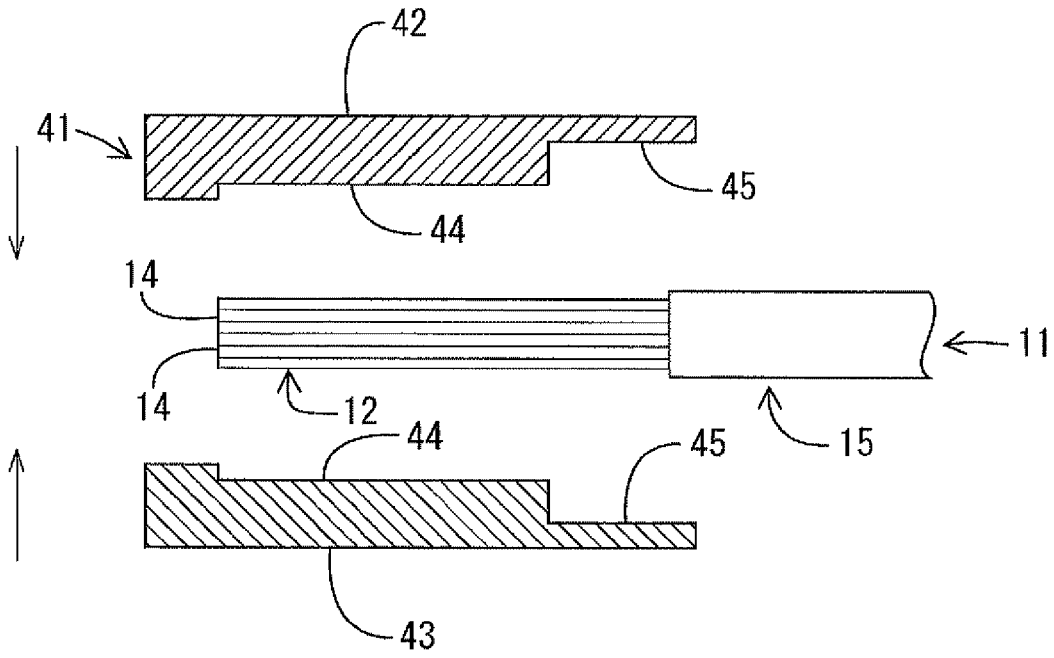
FIG. 9 is a cross-sectional view of the electric wire and the pressing machine of the third embodiment before a preprocess of the electric wire by the pressing machine.

As illustrated in FIGS. 8 and 9, a pressing machine 41 of this embodiment includes an upper die 42 and a lower die 43. Each of opposed surfaces of the dies 42 and 43 has a shallow rectangular groove 44 formed so as to extend along the axis of the electric wire 11. The core wire 12 of the electric wire 11 is pressed in the shallow rectangular grooves 44. An escape recess 45 is formed continuously from each shallow rectangular groove 44 for holding a part of the electric wire 11 covered by the insulator 15.

Figure 10:
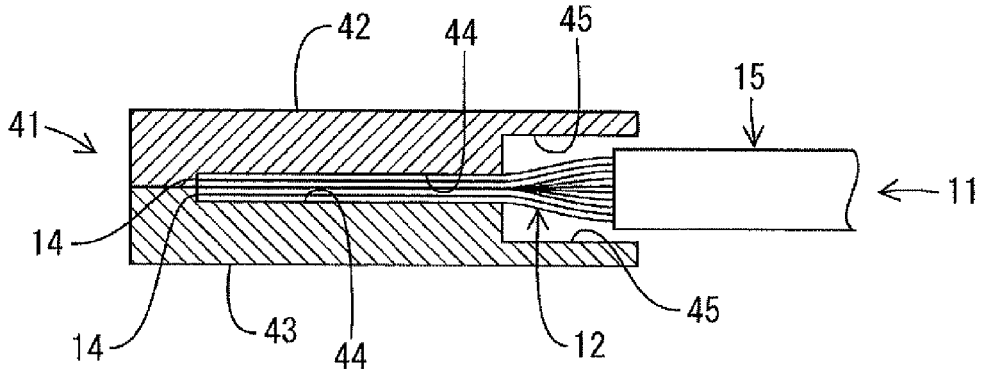
FIG. 10 is a cross-sectional view of the electric wire and the pressing machine of the third embodiment in the preprocess of the electric wire by the pressing machine.

Through the preprocess performed on the core wire 12 of the electric wire 11 by the pressing machine 41, the core wire 12 is pressed and plastically deformed into a flattened quadrangular column-like shape along the shallow rectangular grooves 44 as illustrated in FIG. 10. The adjacent metal wires 14 rub against each other while they are firmly pressed and deformed. As a result, even when the metal oxide layers are formed on the surface of the metal wires 14, many cracks are created in the metal oxide layers and new metal surfaces may emerge from the metal oxide layers.

Similar to the first embodiment, even when the pressure applied in the crimping process of the terminal 13 is reduced, sufficient areas of the new metal surfaces of the core wire 12 emerging from the metal oxide layers are properly in contact with the terminal 13. Therefore, the contact resistance between the core wire 12 and the wire barrel 17 can be reduced.

Fourth Embodiment

The fourth embodiment will be explained with reference to FIGS. 11 to 14. A preprocess of this embodiment is different from that of the first embodiment but other configurations are the same as the first embodiment. The same parts as those of the first embodiment will be indicated by the same symbols and will not be explained.

Figure 11:
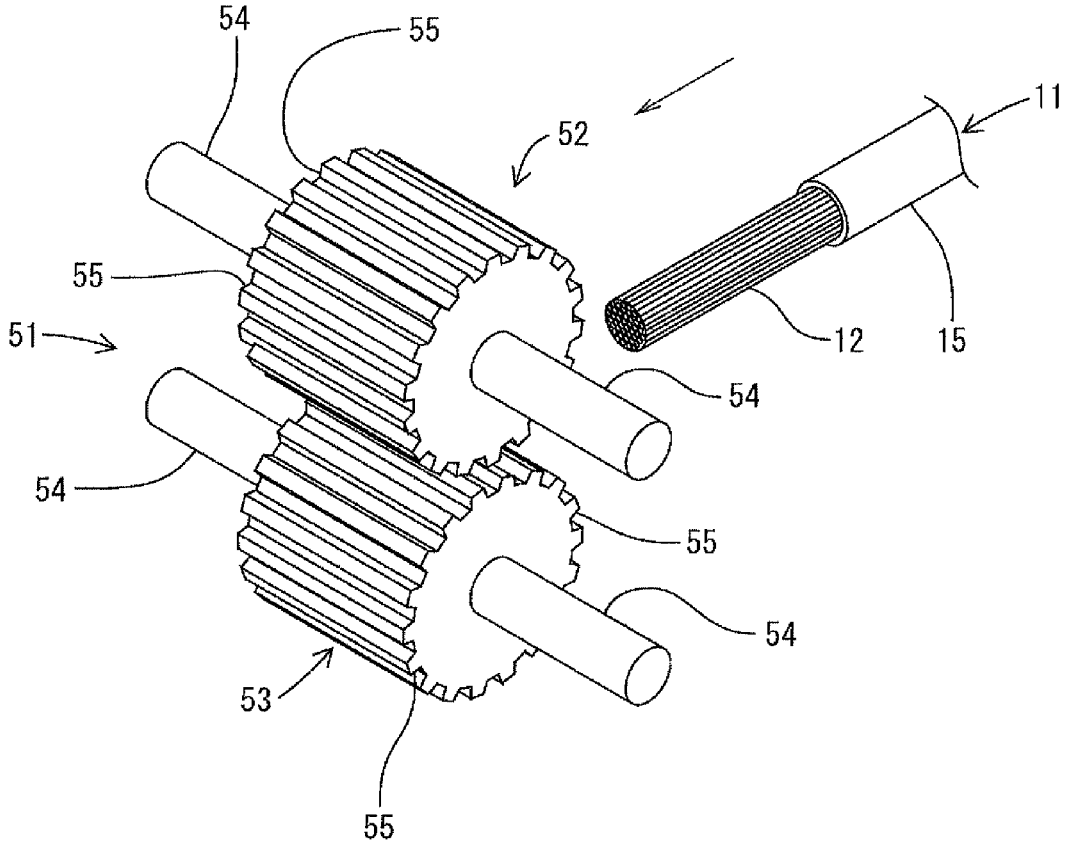
FIG. 11 is a perspective view of an electric wire and a roll-pressing machine of the fourth embodiment before a preprocess of the electric wire by the roll-pressing machine.

As illustrated in FIG. 11, the core wire 12 is roll-pressed by a roll-pressing machine 51 in the preprocess of this embodiment. The roll-pressing machine 51 includes a pair of rollers 52 and 53. Each of the upper roller 52 and the lower roller 53 has a columnar shape. Roller shafts 54 project from the respective ends of the rollers 52 and 53. The center of each roller 52 or 53 is aligned with the center of the corresponding roller 52 or 53 and the diameter thereof is smaller than that of the roller 52 or 53.

Figure 12:
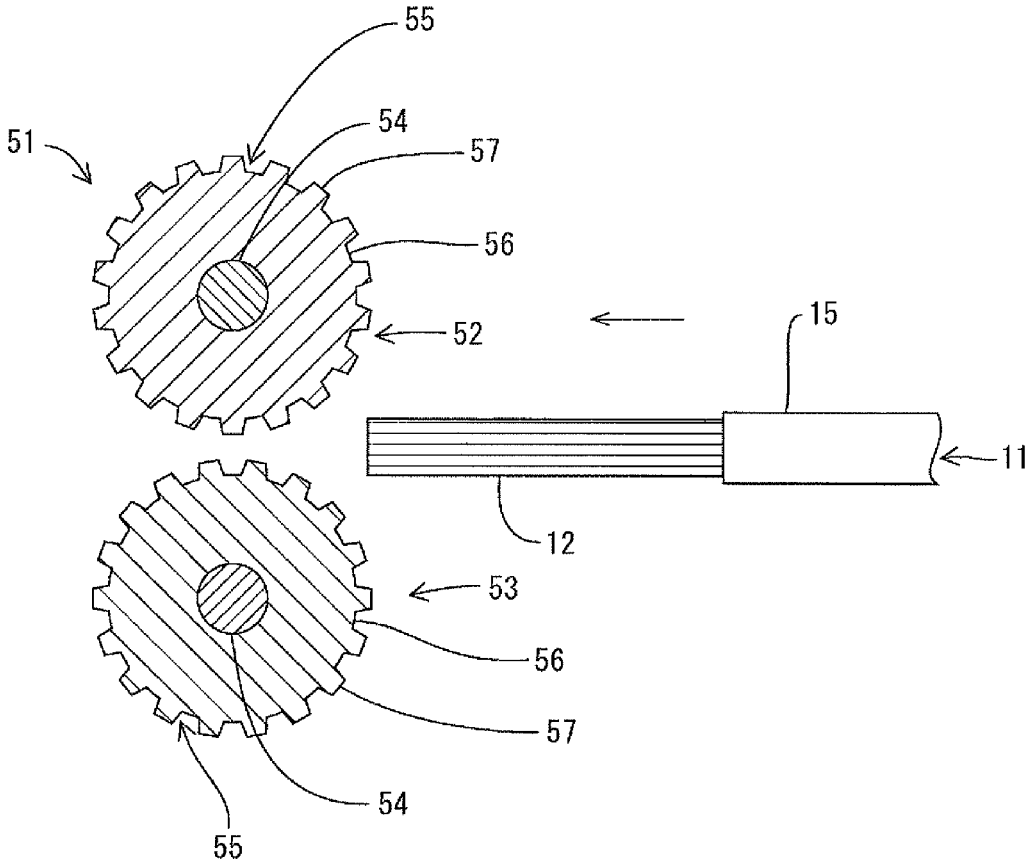
FIG. 12 is a cross-sectional view of the electric wire and the roll-pressing machine of the fourth embodiment before the preprocess of the electric wire by the roll-pressing machine.

As illustrated in FIG. 12, an outer surface of each roller 52 or 53 has rectangular grooves 55 that extend parallel to the roller shaft 54. The rectangular grooves 55 are formed at predetermined intervals in entire surfaces of the rollers 52 and 53. When the upper roller 52 and the lower roller 53 are brought closest to each other, recessed portions 56 and the protruding portions 57 of the upper roller 52 are aligned with respective protruding portions 57 and recessed portions 56 of the lower roller 53.

Figure 13:
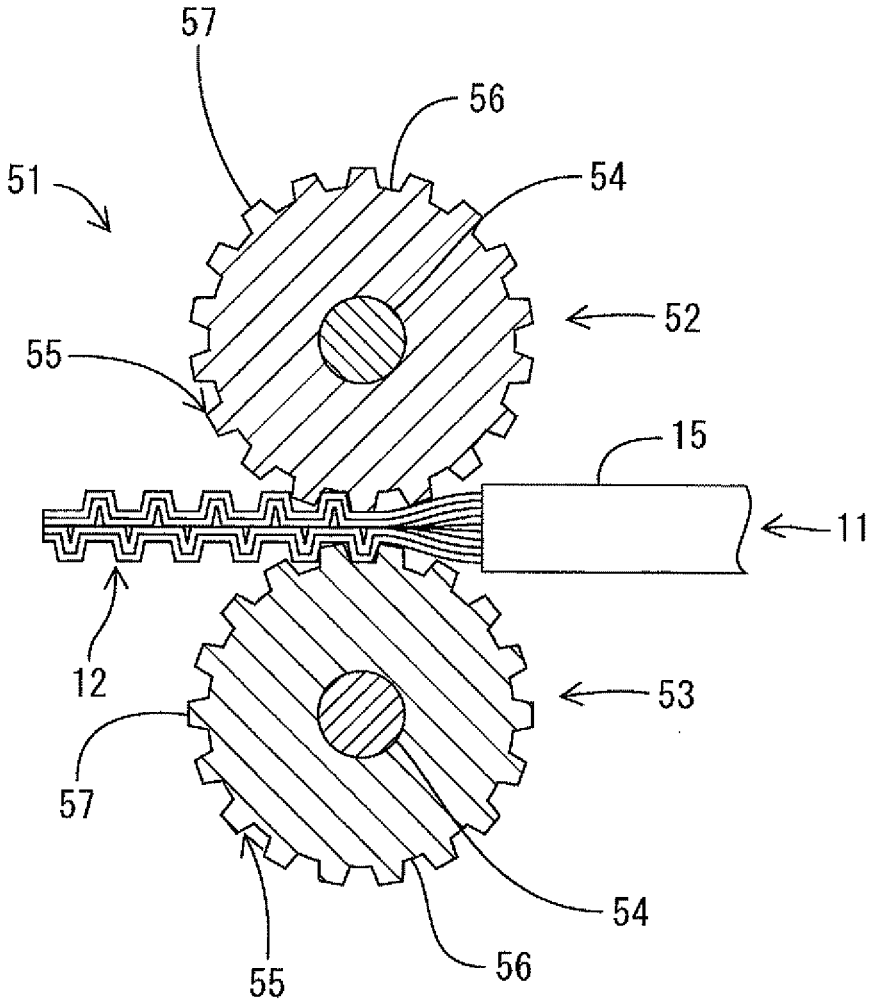
FIG. 13 is a cross-sectional view of the electric wire and the roll-pressing machine of the fourth embodiment in the preprocess of the electric wire by the roll-pressing machine.
Figure 14:
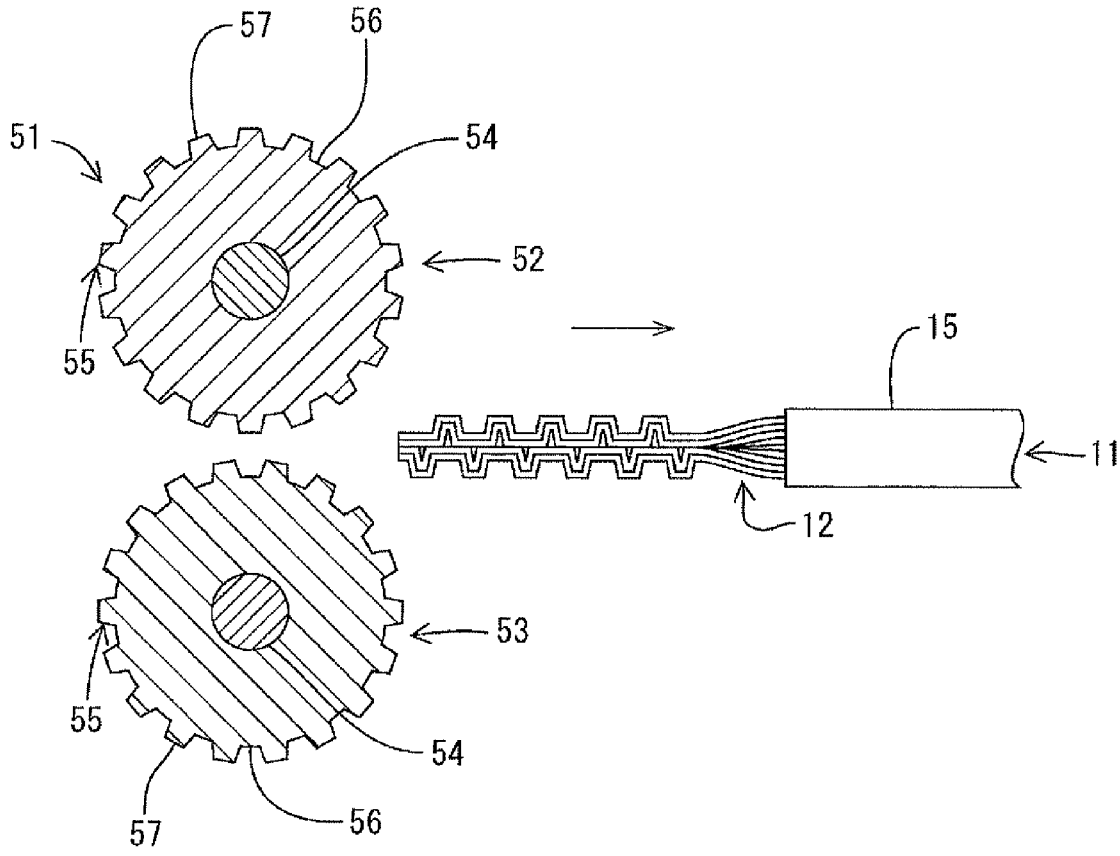
FIG. 14 is a cross-sectional view of the electric wire and the roll-pressing machine of the fourth embodiment after the preprocess of the electric wire by the roll-pressing machine.

As illustrated in FIG. 13, the core wire 12 of the electric wire 11 is sandwiched between the rollers 52 and 53 of the roll-pressing machine 51 and roll-pressed. After the core wire 12 is passed between the rollers 52 and 53, the rotations of the rollers 52 and 53 are reversed. As a result, the core wire 12 between the rollers 52 and 53 is removed from the rollers 52 and 53.

Through the preprocess performed on the core wire 12 of the electric wire 11 by the roll-pressing machine 51, the core wire 12 is plastically deformed into a rectangular wave-like shape. Surfaces of the core wire 12 at bent parts thereof in rectangular shapes are stretched along the longitudinal direction of the core wire 12. Therefore, even when metal oxide layers (aluminum oxide layers for the aluminum alloy) are formed on the surfaces of the core wire 12, many cracks are created in the metal oxide layers in the bent parts. New metal surfaces may emerge from the metal oxide layers.

Similar to the first embodiment, even when the pressure applied in the crimping process of the terminal 13 is reduced, sufficient areas of the new metal surfaces of the core wire 12 emerging from the metal oxide layers are properly in contact with the terminal 13. Therefore, the contact resistance between the core wire 12 and the wire barrel 17 can be reduced.

Fifth Embodiment

The fifth embodiment will be explained with reference to FIGS. 15 to 18. A preprocess of this embodiment is different from that of the first embodiment but other configurations are the same as the first embodiment. The same parts as those of the first embodiment will be indicated by the same symbols and will not be explained.

Figure 15:
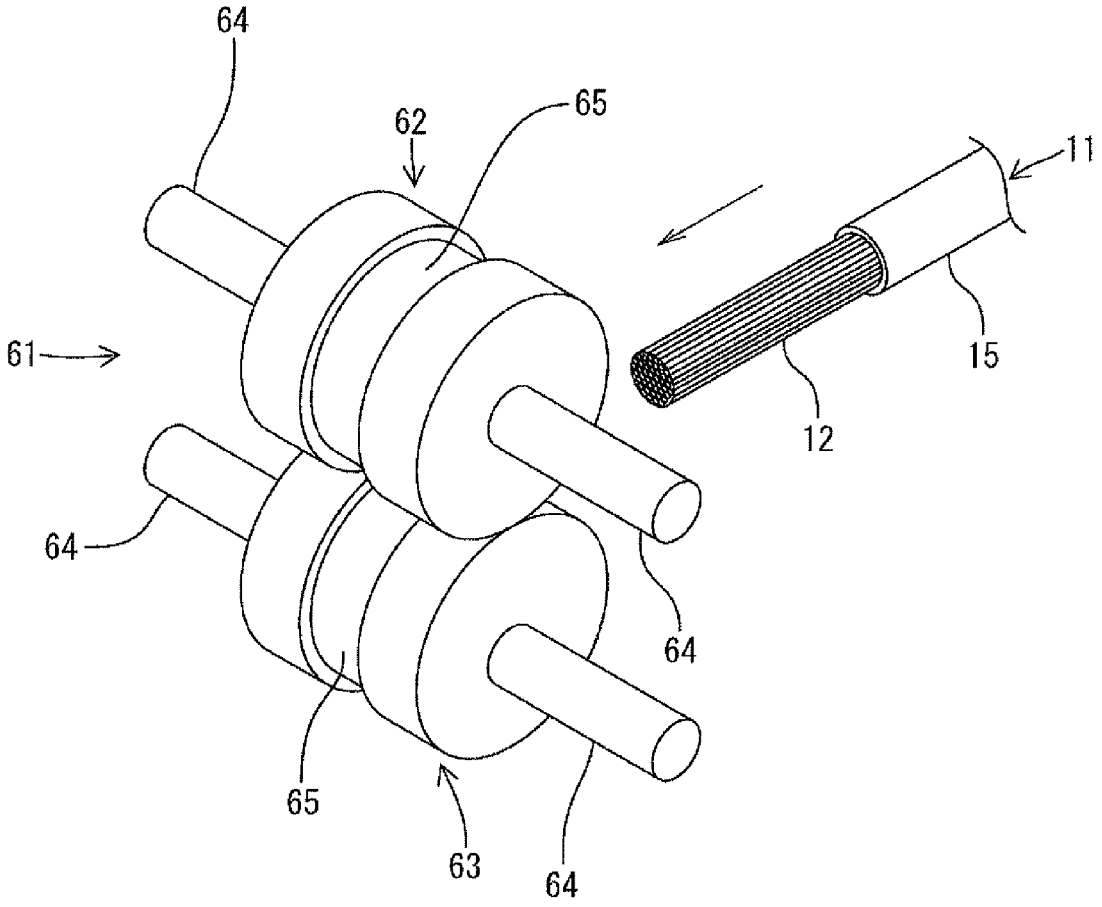
FIG. 15 is a perspective view of an electric wire and a roll-pressing machine of the fifth embodiment before a preprocess of the electric wire by the roll-pressing machine.
Figure 16:
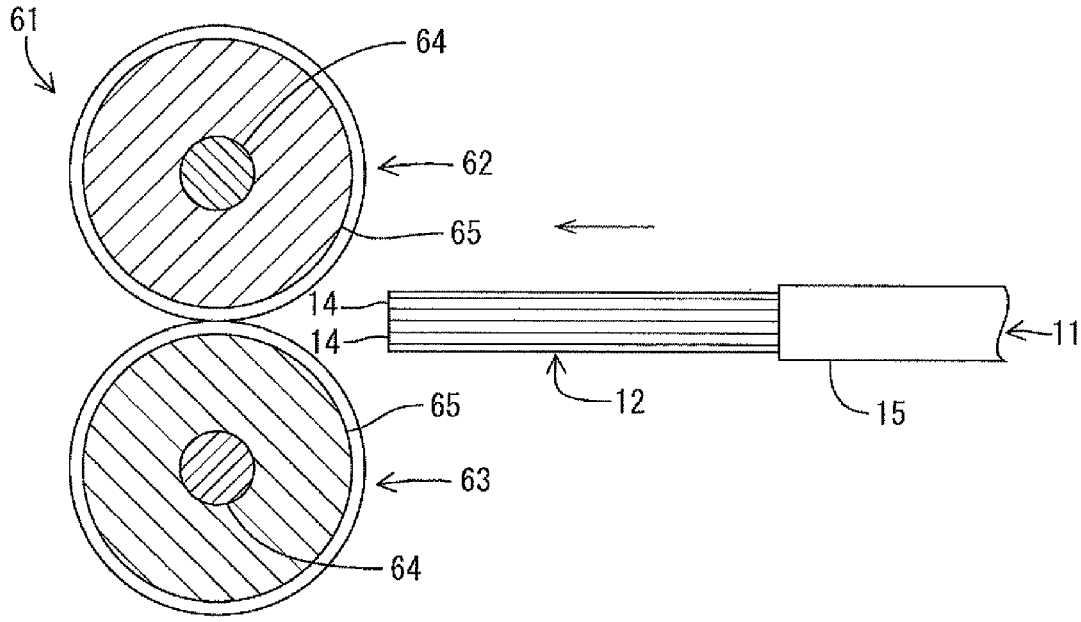
FIG. 16 is a cross-sectional view of the electric wire and the roll-pressing machine of the fifth embodiment before the preprocess of the electric wire by the roll-pressing machine.

As illustrated in FIG. 15, the core wire 12 is roll-pressed by a roll-pressing machine 61 in the preprocess of this embodiment. The roll-pressing machine 61 includes a pair of rollers 62 and 63. A surface of each roller 62 or 63 has a shallow groove 65 that extends perpendicular to a roller shaft 64 of the roller 62 or 63. When the rollers 62 and 63 are placed against each other, a rectangular hole is formed by the bottoms and the sidewalls of the rollers 62 and 63.

Figure 17:
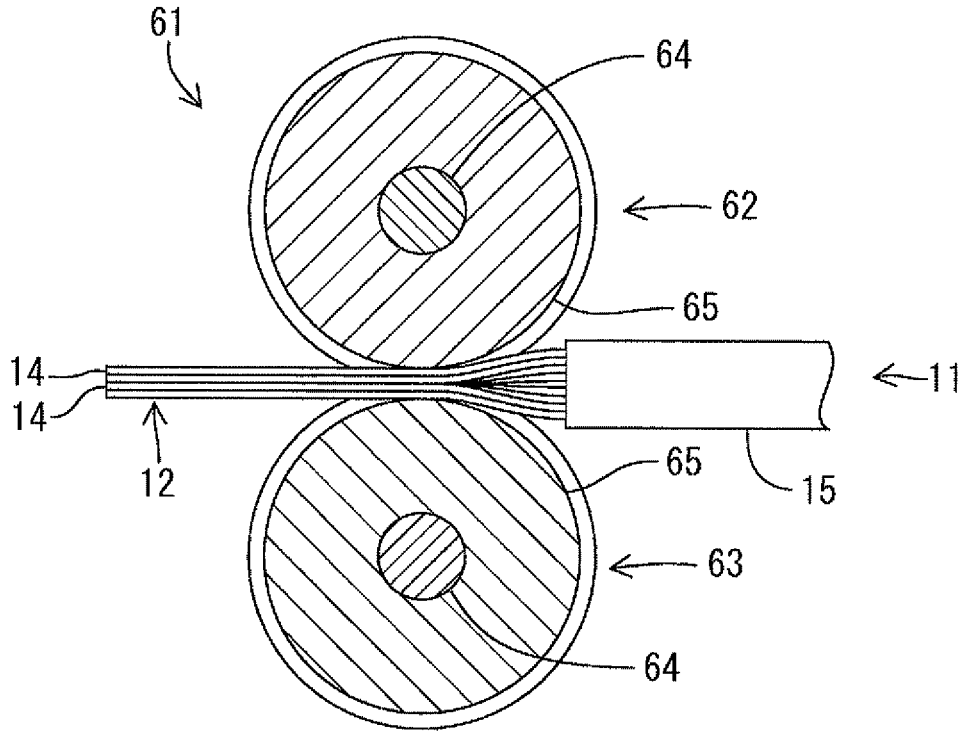
FIG. 17 is a cross-sectional view of the electric wire and the roll-pressing machine of the fifth embodiment in the preprocess of the electric wire by the roll-pressing machine.
Figure 18:
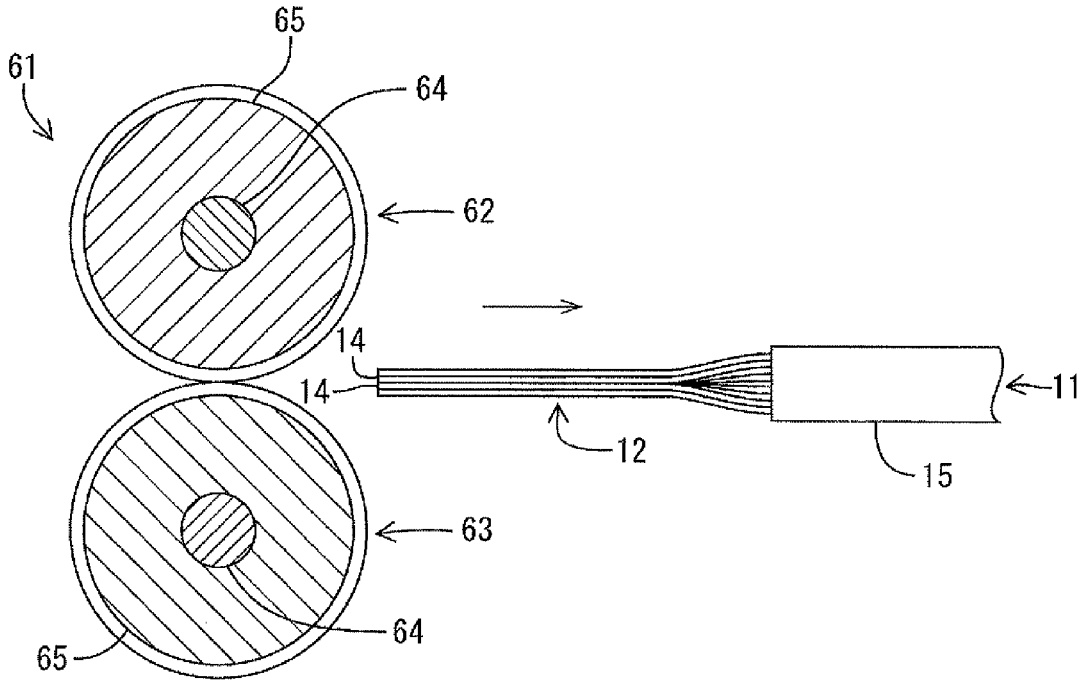
FIG. 18 is a cross-sectional view of the electric wire and the roll-pressing machine of the fifth embodiment after the preprocess of the electric wire by the roll-pressing machine.

As illustrated in FIG. 17, the core wire 12 of the electric wire 11 is inserted in the rectangular hole formed between the rollers 62 and 63 of the roll-pressing machine 61, and roll pressed by the rollers 62 and 63. After the core wire 12 is passed between the rollers 62 and 63, the rotations of the rollers 62 and 63 are reversed. As a result, the core wire 12 between the rollers 62 and 63 is removed from the rollers 62 and 63 as illustrated in FIG. 18.

Through the preprocess performed on the core wire 12 of the electric wire 11 by the roll-pressing machine 61, the core wire 12 is plastically deformed into a quadrangular column-like shape corresponding to the rectangular hole. The adjacent metal wires 14 rub against each other while they are firmly pressed and deformed. As a result, even when the metal oxide layers are formed on the surface of the metal wires 14, many cracks are created in the metal oxide layers and new metal surfaces emerge from the metal oxide layers.

Similar to the first embodiment, even when the pressure applied in the crimping process of the terminal 13 is reduced, sufficient areas of the new metal surfaces of the core wire 12 emerging from the metal oxide layers are properly in contact with the terminal 13. Therefore, the contact resistance between the core wire 12 and the wire barrel 17 can be reduced.

Other Embodiments

The present invention is not limited to the above embodiments explained in the above description with reference to the drawings. The following embodiments may be included in the technical scope of the present invention, for example.

(1) In the above embodiments, the core wire constructed of a plurality of wires is used. However, a core wire constructed of a single wire can be used.

(2) In the above embodiments, the pressing process or the roll-pressing process are performed for creating the cracks in the metal oxide layers by applying mechanical forces. However, a brushing process in which a surface of the core wire is brushed by a metal brush may be performed instead of the above process.

Figure 19:
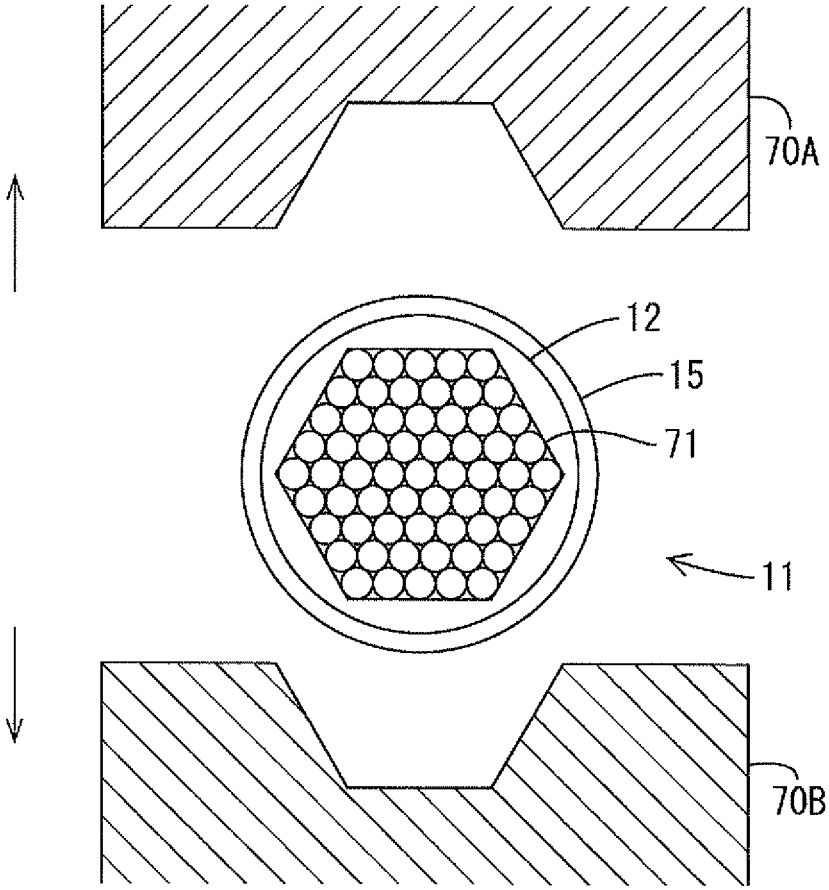
FIG. 19 is a cross-sectional view of an electric wire and a pressing machine of another embodiment after a preprocess of the electric wire by the pressing machine.

(3) In the third embodiment, the core wire 12 is plastically deformed into the flattened quadrangular column-like shape (having a rectangular cross section) in the preprocess performed by the pressing machine 41. However, the core wire 12 may be plastically deformed into a different type of quadrangular column-like shape, that is, other than a rectangular column-like shape, from the flattened quadrangular column-like shape (or the rectangular column-like shape). Furthermore, the core wire 12 may be plastically deformed into a polygonal column-like shape other than the quadrangular column-like shape. For example, a preprocess may be performed by a pressing machine having an upper die 70A and a lower die 70B illustrated in FIG. 19. Through the preprocess, a part of a round core wire 12 is plastically deformed into a hexagonal column-like shape and prepared as a plastically-deformed portion 71.

Figure 20:
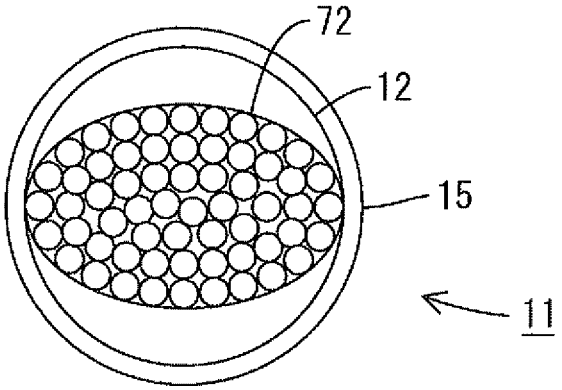
FIG. 20 is a cross-sectional view of an electric wire after a preprocess by a pressing machine of another embodiment.
Figure 21:
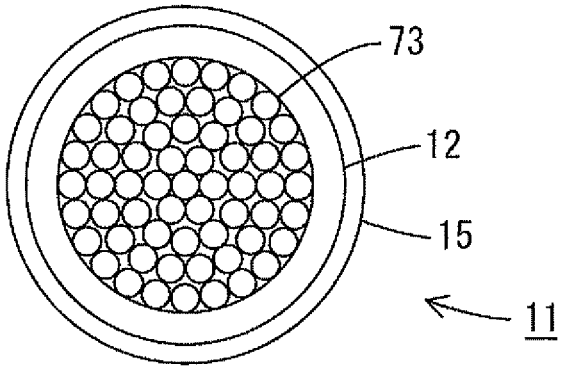
FIG. 21 is a cross-sectional view of an electric wire after a preprocess according to another embodiment.
Figure 22:
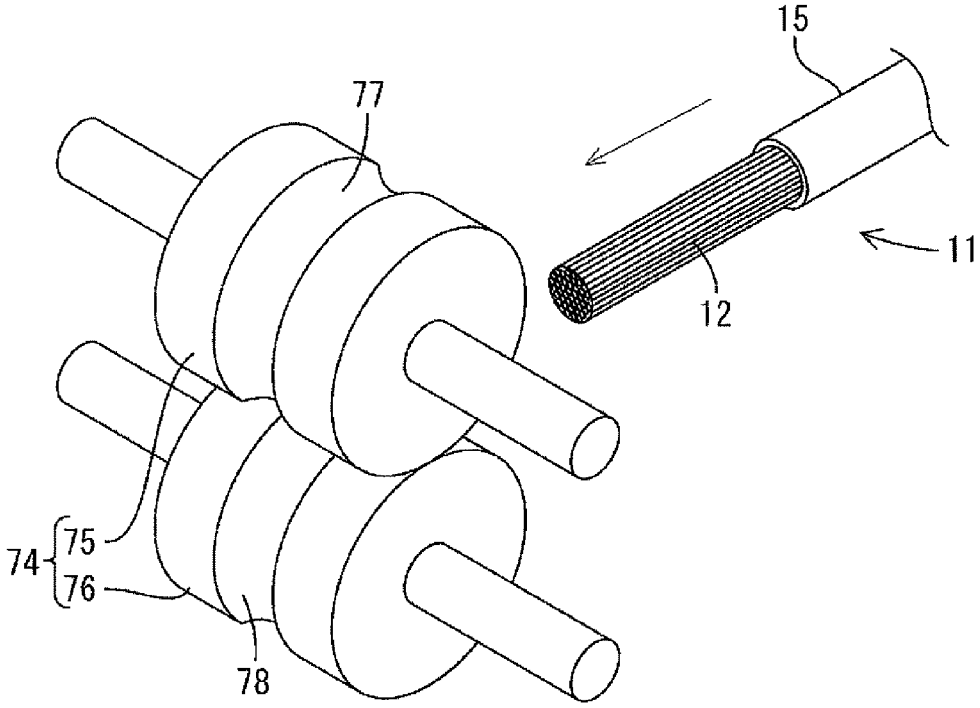
FIG. 22 is a perspective view of an electric wire and a roll-pressing machine of another embodiment before a preprocess by the roll-pressing machine.
Figure 23:
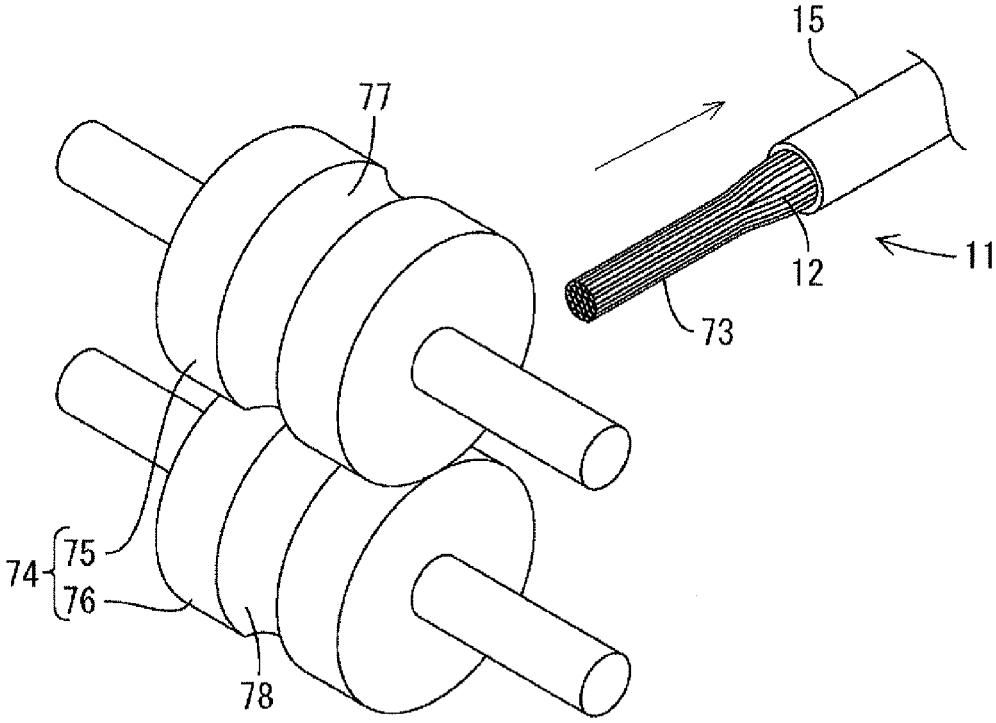
FIG. 23 is a perspective view of the electric wire and the roll-pressing machine of the other embodiment after the preprocess by the roll-pressing machine.

Furthermore, the core wire 12 may be formed in a shape other than a polygonal column-like shape. For example, a part of the core wire 12 may be plastically deformed into an elliptic column-like shape and prepared as a plastically-deformed portion 72 illustrated in FIG. 20 in a preprocess performed using dies. Still furthermore, a part of the core wire 12 may be plastically deformed such that a diameter (or a radius) thereof is reduced in this preprocess and prepared as a plastically-deformed portion 73. The plastically-deformed portion 73 (or a reduced diameter portion) may be prepared by a pressing machine or a roll-pressing machine. As illustrated in FIG. 22, an upper roller 75 and a lower roller 76 of a roll-pressing machine 74 have half round (round-arched) grooves 77 and 78 respectively in the outer surfaces. As illustrated in FIG. 23, a part of the core wire 12 is pressed in a round hole formed by the grooves 77 and 78 of the rollers 75 and 76, and prepared as a plastically-deformed portion 73 (or a reduced diameter portion).

(4) In the preprocess, ultrasonic vibrations may be applied to the wires of the core wire 12 to create rough areas (with microscopic asperities) on the surfaces of the metal wires 14. The rough areas may be created by applying ultrasonic vibrations to the metal wires 14 through the dies used in the preprocess for plastically deforming the core wire 12.

When forces are applied to the wires 14 by the wire barrel during the crimping of the wire barrel onto the core wire 12 including the wires 14 having the rough areas, the wires 14 rub against each other. When the rough areas on the surfaces of the wires 14 rub against each other, the oxide layers on the surfaces of the wires 14 are removed. As a result, new surfaces of the wires 14 emerge. When the emerged new surfaces are in contact with each other, the wires 14 are electrically connected to each other. The wires 14 located inner in a radial direction of the core wire 12 can be used for electrical connection between the electric wire 11 and the terminal 13. Therefore, the contact resistance between the electric wire 11 and the terminal 13 can be reduced.

According to this configuration, the rough areas are created by applying ultrasonic vibrations (during the plastic deformation) in addition to the plastic deformation of the core wire 12 (to create cracks in the metal oxide layers by applying mechanical forces). As a result, the contact resistance between the core wire 12 and the wire barrel 17 can be further reduced.

Figure 24:
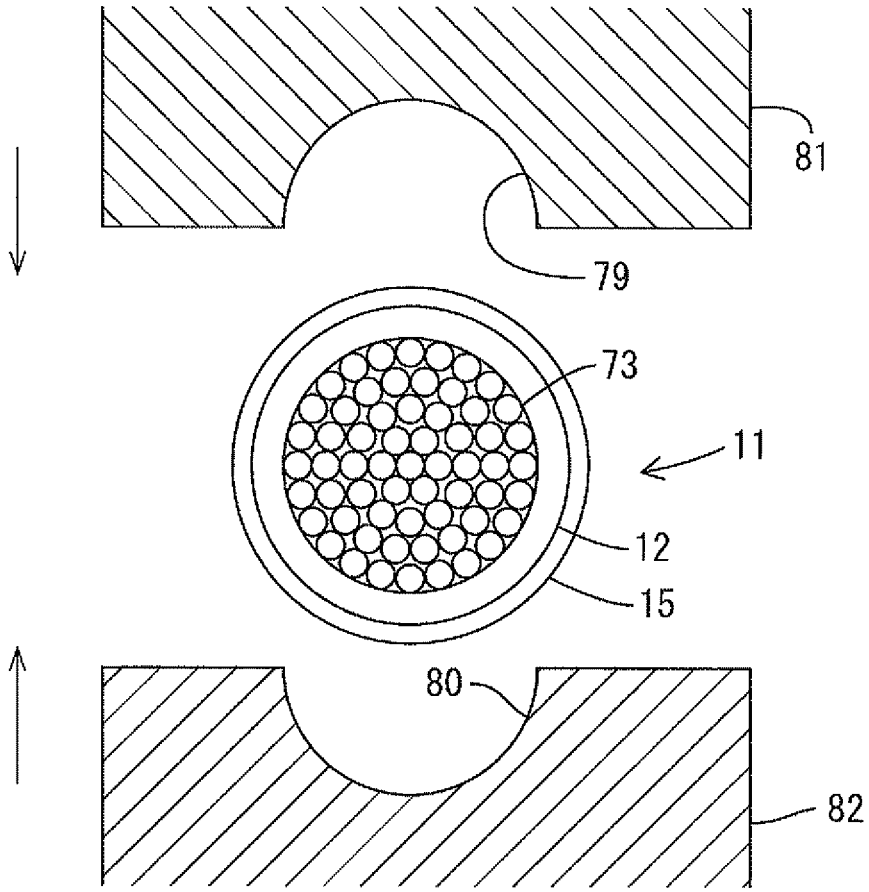
FIG. 24 is a cross-sectional view of the electric wire and the roll-pressing machine of the other embodiment after the preprocess by the roll-pressing machine and before application of ultrasonic vibrations to the electric wire through dies.

The core wire 12 may be roller-pressed instead of pressing with dies as in the process for preparing the plastically-deformed portion 73 (or the reduced diameter portion). In such a case, the plastically-deformed portion 73 (or the reduced diameter portion) may be placed between an upper die 81 having a groove 79 (or a recessed portion) and a lower die 82 having a groove 80 (or a recessed portion) as illustrated in FIG. 24 after the plastically-deformed portion 73 (or the reduced diameter portion) is formed by roll-pressing. Each groove 79 or 80 has the same diameter as that of the plastically-deformed portion 73 (or the reduced diameter portion). The dies 81 and 82 are provided as dies that do not plastically deform the core wire. Ultrasonic vibrations can be applied to the core wire 12 through the dies 81 and 82.

The invention claimed is:

1. A method for manufacturing an electric wire with a terminal, comprising:

crimping a barrel portion of the terminal onto a core wire constructed of metal wires; and creating a crack in a metal oxide layer formed on a metal surface of the core wire by applying a mechanical force to the metal oxide layer immediately before the crimping.

2. The method for manufacturing the electric wire with the terminal according to claim 1, wherein the creating is accomplished by pressing the core wire with a die having a predetermined shape and plastically deforming the core wire.

3. The method for manufacturing the electric wire with the terminal according to claim 1, wherein the creating is accomplished by roll-pressing the core wire such that the core wire is sandwiched between rollers having protrusions and recesses and plastically deforming the core wire into a shape corresponding to the protrusions and the recesses, each of the protrusions and each of the recess of one of the rollers being aligned with one of the recesses and one of the protrusions of another one of the rollers, respectively.

4. The method for manufacturing the electric wire with the terminal according to claim 1, wherein the core wire is made of any one of aluminum and aluminum alloy.

* * * * *